US012523227B2

(12) United States Patent
Collins et al.

(10) Patent No.: US 12,523,227 B2
(45) Date of Patent: Jan. 13, 2026

(54) ROTARY SCREW COMPRESSOR

(71) Applicant: Ingersoll-Rand Industrial U.S., Inc., Davidson, NC (US)

(72) Inventors: James Christopher Collins, Mooresville, NC (US); Willie Dwayne Valentine, Statesville, NC (US)

(73) Assignee: Ingersoll-Rand Industrial U.S., Inc., Davidson, NC (US)

( * ) Notice: Subject to any disclaimer, the term of this patent is extended or adjusted under 35 U.S.C. 154(b) by 521 days.

(21) Appl. No.: 17/840,285

(22) Filed: Jun. 14, 2022

(65) Prior Publication Data

US 2022/0316480 A1 Oct. 6, 2022

Related U.S. Application Data

(62) Division of application No. 14/530,177, filed on Oct. 31, 2014, now Pat. No. 11,359,632.

(51) Int. Cl.
*F04C 29/12* (2006.01)
*F04C 18/16* (2006.01)
(Continued)

(52) U.S. Cl.
CPC ..... *F04C 29/04* (2013.01); *F04C 18/16* (2013.01); *F04C 23/005* (2013.01); *F04C 29/0014* (2013.01)

(58) Field of Classification Search
CPC ..... F04C 18/107; F04C 18/14; F04C 18/16; F04C 18/165; F04C 18/18; F04C 18/20;
(Continued)

(56) References Cited

U.S. PATENT DOCUMENTS 2,325,617 A 7/1943 Lysholm et al.
2,605,619 A 8/1952 Serduke
(Continued)

FOREIGN PATENT DOCUMENTS

GB 2304380 A * 3/1997 ..... F04C 18/084
JP H06108983 A * 9/1992 ..... F04C 29/04
(Continued)

OTHER PUBLICATIONS

JPH06108983A_MT2, Machine Translation of JP-H06108983-A (Year: 1992).*
(Continued)

*Primary Examiner* — Michael J Tsai
*Assistant Examiner* — Charles W Nichols
(74) *Attorney, Agent, or Firm* — Kevin E. West; Advent, LLP

(57) ABSTRACT

A gas compressor is disclosed that includes a first rotor having a first rotor body, the first rotor body including a plurality of helical lobes, an internal volume within the first rotor body defined by a wall, and a turbine disposed within the internal volume, the turbine including a turbine body and a plurality of airfoils extending substantially radially from the turbine body to the wall, where the internal volume is structured to enable a cooling fluid to flow therethrough. The gas compressor further includes a second rotor body including a plurality of helical flutes, an inlet manifold and an outlet manifold, both disposed within the second rotor body, and a body channel within at least one flute extending from and in fluid communication with the inlet manifold to the outlet manifold, where the body channel is structured to enable a cooling fluid to flow therethrough.

18 Claims, 10 Drawing Sheets

(51) Int. Cl.

| | |
|---|---|
| ***F04C 23/00*** | (2006.01) |
| ***F04C 29/00*** | (2006.01) |
| ***F04C 29/02*** | (2006.01) |
| ***F04C 29/04*** | (2006.01) |

(58) Field of Classification Search
CPC ..... F04C 23/005; F04C 29/0007; F04C 29/0014; F04C 29/04; F04C 29/042; F04C 2240/20; F04C 2250/20; F01C 3/00; F01C 3/02; F01C 3/025; F03B 3/12; F03B 3/121; F03B 13/00
USPC ..... 417/410.4
See application file for complete search history.

(56) References Cited

U.S. PATENT DOCUMENTS

| | | | | |
|---|---|---|---|---|
| 2,799,253 | A * | 7/1957 | Lindhagen | F01D 5/08 418/94 |
| 2,801,792 | A * | 8/1957 | Lindhagen | F04C 18/084 418/104 |
| 3,656,583 | A | 4/1972 | Hornbeck | |
| 3,811,805 | A | 5/1974 | Moody, Jr. et al. | |
| 4,912,824 | A | 4/1990 | Baran | |
| 5,772,418 | A | 6/1998 | Tateno et al. | |
| 6,334,755 | B1 | 1/2002 | Coudray et al. | |
| 8,192,186 | B2 | 6/2012 | Moens | |
| 2005/0069446 | A1 * | 3/2005 | Kriehn | F04C 29/04 418/94 |
| 2009/0004038 | A1 | 1/2009 | Prior et al. | |
| 2010/0162685 | A1 | 7/2010 | Hirshberg | |
| 2012/0045356 | A1 | 2/2012 | Nachtergaele et al. | |
| 2013/0240655 | A1 | 9/2013 | Yanagawa et al. | |

FOREIGN PATENT DOCUMENTS

| | | | |
|---|---|---|---|
| KR | 20010111817 | A | 12/2001 |
| WO | 2010006663 | A1 | 1/2010 |
| WO | 2010142003 | A1 | 12/2010 |
| WO | 2011069845 | A2 | 6/2011 |
| WO | 2012176991 | A2 | 12/2012 |

OTHER PUBLICATIONS

Extended European Search Report for Application No. 15191000.7, dated Jun. 28, 2016.
Office Action for Chinese Application No. 201511036012.0, dated Mar. 5, 2019.

* cited by examiner

ROTARY SCREW COMPRESSOR

CROSS-REFERENCE TO RELATED APPLICATIONS

The present application is a divisional under 35 U.S.C. § 120 of U.S. patent application Ser. No. 14/530,177, filed Oct. 31, 2014, and titled "ROTARY SCREW COMPRESSOR." U.S. patent application Ser. No. 14/530,177 is herein incorporated by reference in its entirety.

TECHNICAL FIELD

The present disclosure generally relates to rotary screw compressors.

BACKGROUND

Conventional rotary screw compressors use intermeshing rotating rotors to create a compression cell (often referred to as a compression chamber) between the rotating rotors, close the cell, and then reduce the cell volume through screw rotation to compress a gas. The intermeshing rotors may be a single main rotor with two gate rotors or twin, axially-aligned, helical screw rotors. Because the gas compression process occurs in a continuous sweeping motion, rotary screw compressors produce very little pulsation or surge in the output flow of compressed gas. However, as described by the physical gas laws, compressing any gas produces heat, and the hotter the gas gets the loss efficient the compression process. Thus, removing heat during the compression process can improve the compression efficiency.

Various means of cooling the gas in the compression cell are known. A common means, known as contact cooling, is to introduce a cooling fluid into the compression process that comes into direct contact with the compressible gas. In contrast, compressing a gas without introducing a coolant into the compression cell is typically referred to as "dry" compression. At equivalent compression ratios, dry screw compressors generates higher temperatures than contact-cooled screw compressors because there is no fluid cooling in the compression cell. Alternative methods of cooling the compressible gas include jacket cooling, in which a coolant is flowed over the housing of the screw compressor, and internal cooling, in which a coolant is flowed through a screw rotor that is manufactured hollow. Such hollow rotors are generally manufactured with laminated stampings, straight-drill machining, casting, extruding, or hydroforming processes.

Some existing screw compressor systems have various shortcomings relative to cooling the compression process. Accordingly, there remains a need for further contributions in this area of technology.

SUMMARY

One embodiment of the present invention is a gas compressor system that includes rotors having flow paths for a cooling fluid formed therethrough to enable cooling of the rotors and to increase the efficiency of the compressor. Other embodiments include apparatuses, systems, devices, hardware, methods, and combinations for generating a drive torque using the flow of a cooling fluid through the rotors as the cooling fluid is heated by the rotors. Further embodiments, forms, features, aspects, benefits, and advantages of the present application shall become apparent from the description and figures provided herewith.

BRIEF DESCRIPTION OF THE FIGURES

Features of the invention will be better understood from the following detailed description when considered in reference to the accompanying drawings, in which.

DETAILED DESCRIPTION

Figure 1:
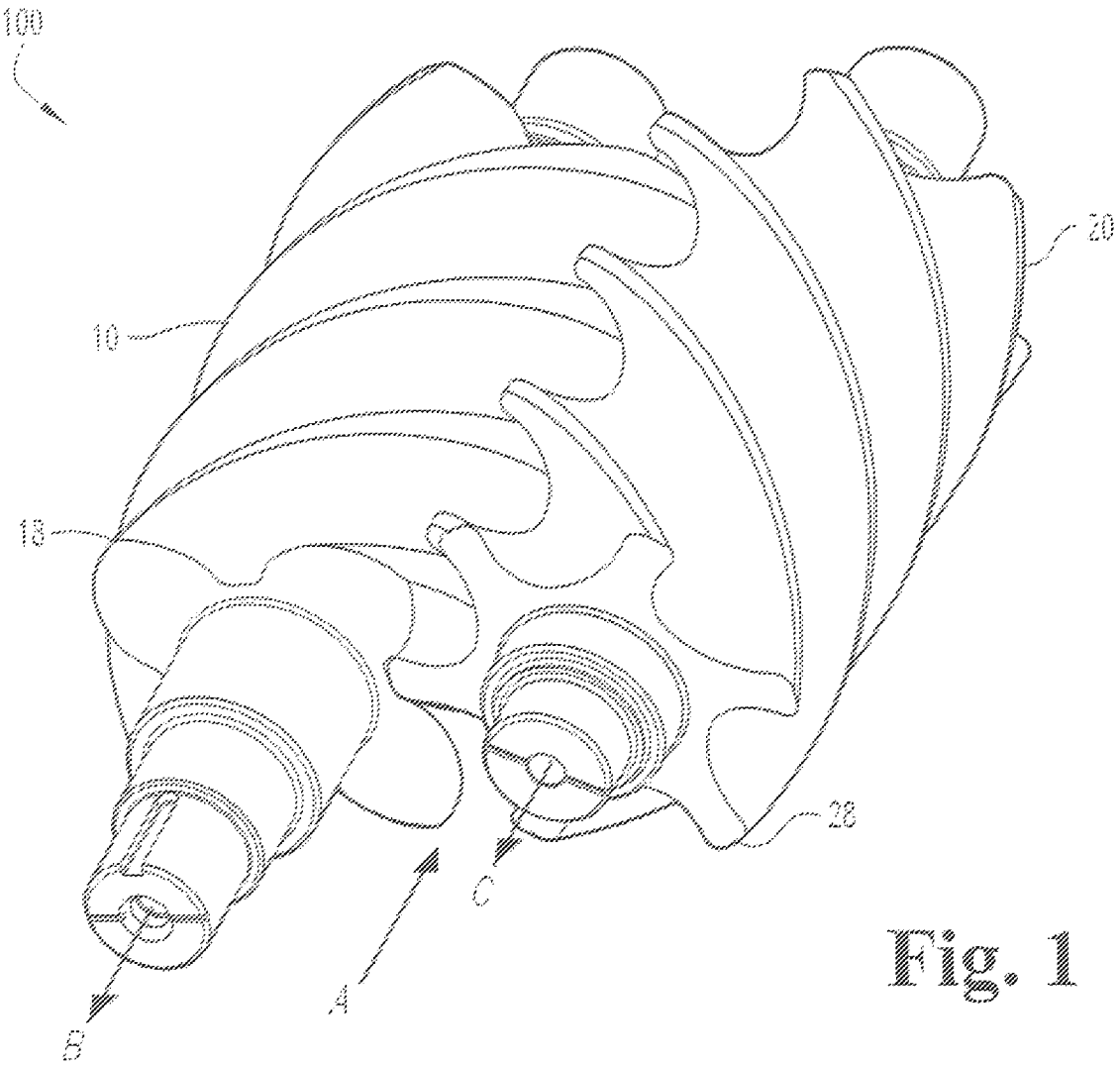
FIG. 1 shows a perspective view of an embodiment of a gas compressor according to the present disclosure.

The present application discloses various embodiments of a gas compressor and methods for using and constructing the same. In one aspect of the disclosure, a gas compressor may include rotors having interval flow paths through which a cooling fluid may be flowed to absorb heat generated by the compression process. For the purposes of promoting an understanding of the principles of the invention, reference will now be made to the embodiments illustrated in the drawings, and specific language will be used to describe the same. It will nevertheless be understood that no limitation of the scope of the invention is thereby intended. Any alterations and further modifications in the described embodiments, and any further applications of the principles of the invention as described herein, are contemplated as would normally occur to one skilled in the art to which the invention relates having the benefit of the present disclosure.

A gas compressor according to at least one embodiment of the present disclosure is shown in FIG. 1. As shown in FIG. 1, a gas compressor 100 may include a male rotor 10 disposed adjacent a female rotor 20 within a housing (not shown) having a gas inlet and outlet. The male rotor 10 and female rotor 20 may be structured to intermesh with one another to compress a gas, or more generally a working fluid, as the male rotor 10 and female rotor 20 are rotated about their respective longitudinal axes. The male rotor 10 and female rotor 20 intermesh along helical threads formed in each rotor 10, 20, the threads providing complementary compression surfaces that each define a helical shape. The threads of the male rotor 10 may include lobes 18 having relatively narrow valleys formed between relatively wide adjacent helical teeth. The threads of the female rotor 20 may include flutes 28 having relatively wide valleys formed between relatively narrow adjacent helical teeth. As will be appreciated, either the male rotor 10 or the female rotor 20 may be described as having intermeshing lobes, fluted, teeth, threads, or other appropriate term used in the art. Further, in some applications, the valleys may be referred to as "flutes" instead of as teeth. Nevertheless, for the purpose of the disclosure, the rotor having the wider threads and narrower valleys will be referred to as the male rotor 10, and rotor having the narrower threads and wider valleys will be referred to as the female rotor 20.

In operation, the male rotor 10 and the female rotor 20 rotate to continuously create compression cells between the lobes 18 of the male rotor 10, the flutes 28 of the female rotor 20, and the housing of the compressor 100. The gas to be compressed may be introduced via the inlet along a compressor flow path A. Rotation of the rotors 10, 20 draws the gas to be compressed between the rotors 10, 20 in the direction of flow path A, as shown in FIG. 1, and into the compression cells formed therebetween. As the rotors 10, 20 rotate, each compression cell is closed and then reduced in volume to compress the gas, which generates heat that increases the temperature of the gas and the rotors 10, 20. Rotation of the rotors 10, 20 further pushes the gas out of the compressor 100 via the outlet in a compressed state. However, because compressing a hotter gas requires more energy, the hotter the gas gets, the less efficient the compression process. Thus, removing heat from the male rotor 10 and the female rotor 20 during the compression process can improve the compression efficiency of the gas compressor 100 by cooling the compressed gas. Rotation of the male rotor 10 and female rotor 20 may be driven by a motor, spindle, or other suitable torque source.

To dissipate the heat generated by the compression process and cool the compressed gas, a cooling fluid or refrigerant fluid may be flowed through the male rotor 10 and the female rotor 20 to transfer heat from the gas being compressed to the cooling fluid via the rotors 10, 20 and to transport that heat away from the compression process. The male rotor 10 may be structured to enable a flow of the cooling fluid through the male rotor 10 along a flow path B, thereby absorbing at least a portion of the heat generated by the process of compressing the gas. Further, the female rotor 20 may be structured to enable a flow of the cooling fluid through the female rotor 20 along a flow path C, thereby absorbing at least a portion of the heat generated by the process of compressing the gas. Consequently, the effect of the flow B and the flow C may be to reduce the temperature increase of the gas being compressed, which prevents the loss of work energy and improves the efficiency of the compressor. To the extent that the flow B and the flow C enable the flow A to be maintained at or near a constant temperature, the gas compressor 100 may operate at an isothermal efficiency approaching 100%.

In at least one embodiment, the flow path B and the flow path C may run counter to the flow path A. In such an embodiment, relatively cold cooling fluid in its coldest state is introduced in to the male rotor 10 and female rotor 20 adjacent the end of the compression process near the gas outlet, adjacent the hottest compressed gas temperatures and the greatest heating of the male rotor 10 and the female rotor 20. Thus, the counter-flow of the compressor flow A to the cooling fluid flow B and flow C increases the rate of heat transfer between the relatively hot compressed gas and the relatively cold cooling fluid at a location where cooling of the compressed gas offers the greatest contribution so compressor efficiency. The disclosed counter-flow arrangement enables further advantages as described further herein. In alternative embodiments, the flow path B and the flow path C may run in the same direction as to the flow path A. In further alternative embodiments, one or the other of the flow path B and the flow path C may be selected to run either counter to or with the flow path A.

Figure 2:
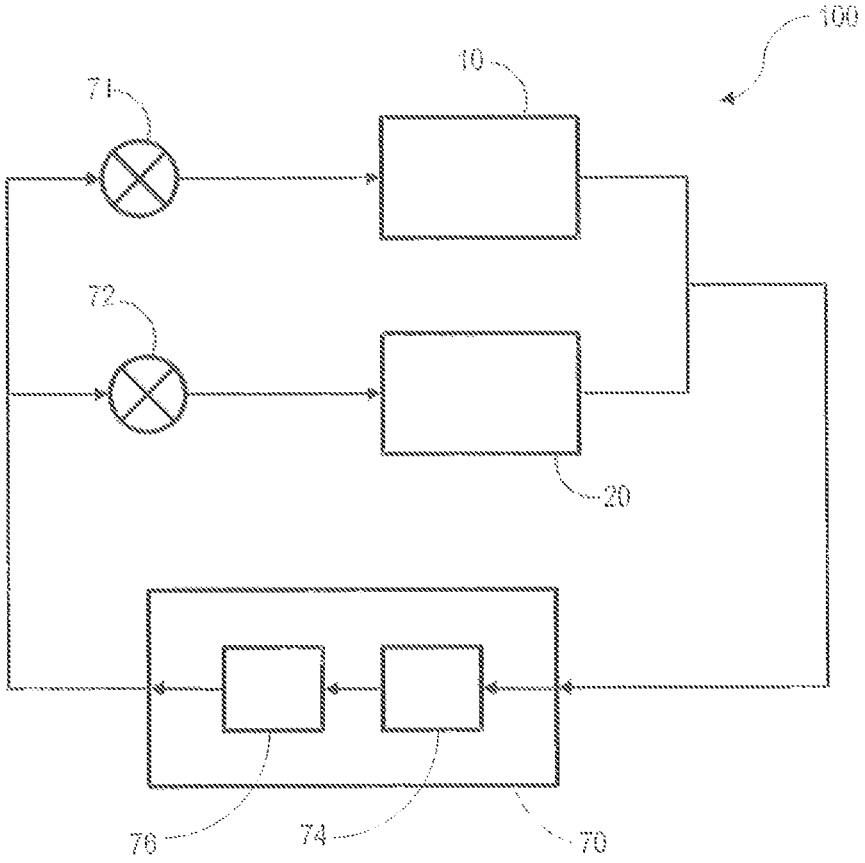
FIG. 2 shows a schematic view of an embodiment of a gas compressor according to the present disclosure.

The gas compressor 100 may include a refrigeration subsystem 70 in fluid communication with the male rotor 10 and the female rotor 20 as shown in FIG. 2. The refrigeration subsystem 70 may cool and pressurize the cooling fluid after it flows through the male rotor 10 and the female rotor 20 such that the cooling fluid may be returned to a relatively cold and high pressure state before being recirculated through the male rotor 10 and the female rotor 20. Accordingly, the cooling fluid may be continuously circulated through the gas compressor 100 drawing heat from the gas being compressed via the male rotor 10 and the female rotor 20 and dissipating that heat in the refrigeration subsystem 70. The refrigeration subsystem 70 may include aspects of a conventional vapor-compression cycle, including a refrigerant compressor 74 in fluid communication with a condenser 76.

In at least one embodiment, the gas compressor 100 may include a male valve 71 disposed between the refrigeration subsystem 70 and the male rotor 10 and may further include a female valve 72 disposed between the refrigeration subsystem 70 and female rotor 20. The male valve 71 may meter the flow B of cooling fluid through the male rotor 10 and separate the relatively high pressure fluid flow of the condenser 76 of the refrigeration subsystem 70 from the male rotor 10 and from flow effects from the female rotor 20. Similarly, the female valve 72 may meter the flow C of cooling fluid through the female rotor 20 and separate the relatively high pressure fluid How of the condenser 76 of the refrigeration subsystem 70 from the female rotor 20 and from flow effects from the male rotor 10. Thus, relatively cold cooling fluid in a primarily liquid state is provided to the male rotor 10 and the female rotor 20 at a pressure lower than the refrigerant compressor 74 of the refrigeration subsystem 70. In operation, if the temperature of the cooling fluid downstream of the valves 71, 72 (e.g., within the male rotor 10 and/or female rotor 20) becomes higher than desired, the valves 71, 72 may be opened further to increase the flow rate of cooling fluid through the male rotor 10 and/or female rotor 20, thereby increasing the heat capacity of the cooling fluid flow and lowering the temperature. Conversely, if the temperature of the cooling fluid downstream of the valves 71, 72 becomes lower than desired, the valves 71, 72 may be closed partially to decrease the flow rate of cooling fluid through the male rotor 10 and/or female rotor 20, thereby decreasing the heat capacity of the cooling fluid flow and raising the temperature.

The male valve 71 and the female valve 72 may be any suitable metering device capable of changing the flow therethrough in response to changes in downstream pressure and temperature. By way of non-limiting example, the male valve 71 and the female valve 72 may be mechanical thermal expansion valves and/or electronically controlled valves, which may have an electronic temperature sensor, such as a thermocouple, thermistor, or the like, disposed downstream of the valves 71, 72 in communication with a microprocessor or other suitable control device.

Figure 3:
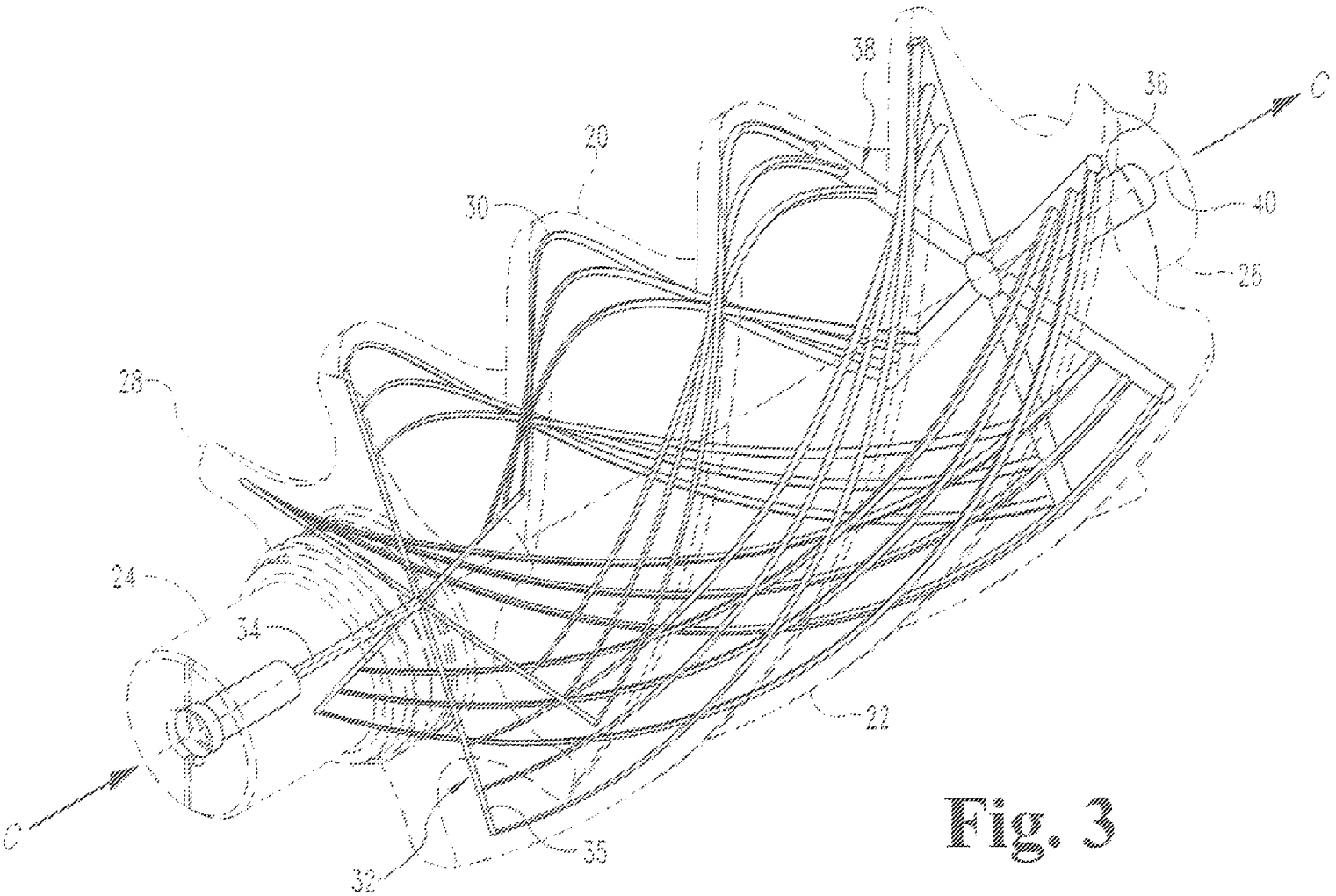
FIG. 3 shows a perspective view of a rotor of a gas compressor according to the present disclosure.

As shown in FIG. 3, the female rotor 20 may include a female body portion 22 disposed between an upstream female shaft portion 24 and a downstream female shaft portion 26 that are connected at opposite ends to the female body portion 22 along a longitudinal axis 42. The female body portion 22 may include a plurality of helical teeth or flutes 28 formed along the axis 42 of the female rotor 20 and extending from the upstream female shaft portion 24 to the downstream female shaft portion 26. The female body portion 22, the upstream female shaft portion 24, and the downstream female shaft portion 26 may be integrally formed as a single component or may be manufactured as separate components that are attached together to form a rigid body.

Figure 4:
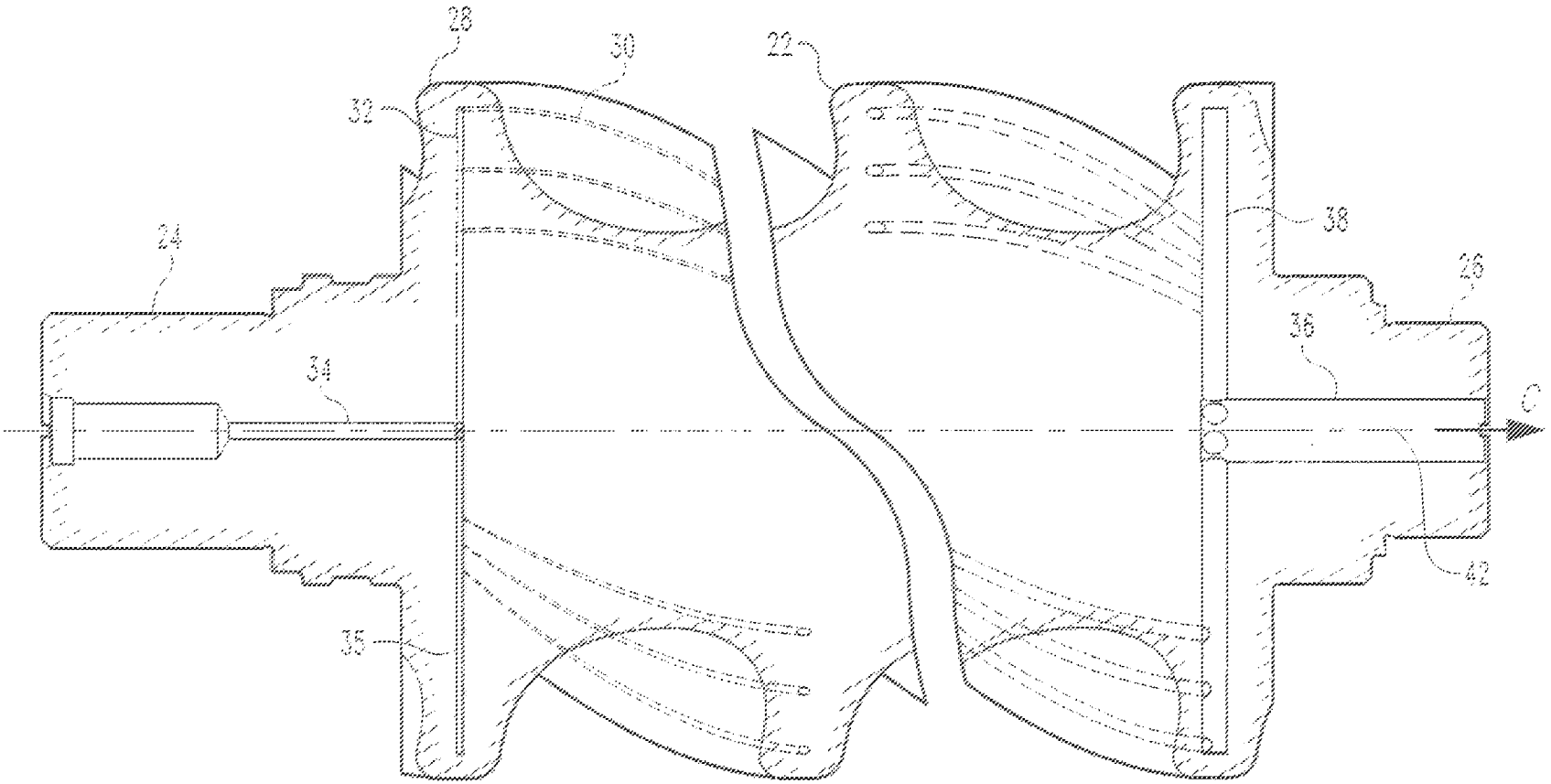
FIG. 4 shows a partial cross-sectional view of a rotor of a gas compressor according to the present disclosure.

As shown in FIGS. 3 and 4, the upstream female shaft portion 24 may include a female inlet channel 34 or passage formed along the axis 42 at or near the center of the upstream female shaft portion 24. Likewise, the downstream female shaft portion 26 may include a female outlet channel 36 or passage formed along the axis 42 at or near the center of the downstream female shaft portion 36. In at least one embodiment, a diameter or width of the downstream female shaft portion 26 may be larger than a diameter or width of the upstream female shaft portion 24, which may enable controlled expansion, while further preventing, choking of the flow as the cooling fluid absorbs heat from the gas being compressed via the female rotor body portion 22, which increases the temperature and pressure for the flow C.

The female body portion 22 may include a plurality of discrete helical cooling channels 30 or passages formed through the helical flutes 28 along the axis 42 and in fluid communication with an upstream manifold 32 and a downstream manifold 38. The female body portion 22 may include at least one cooling channel 30 through each flute 28. In at least one embodiment as shown in FIGS. 3 and 4, the female body portion 22 may include multiple discrete helical cooling channels 30 through each flute 28. Each cooling channel 30, having a length and a diameter or width, may be structured such that the diameter or width of a given cooling channel 30 increases along the length of the cooling channel 30 in the direction of flow path C from the upstream to downstream. In at least one embodiment, the diameter or width of the cooling channel 30 increases continuously in the direction of flow path C. As the diameter or width of a cooling channel 30 increases, so may its cross-sectional area. Accordingly, the diameter or width, and therefore cross-section, of at least one cooling channel 30 may be greater at each location in the downstream direction than in the upstream direction. The increasing cross-section of the cooling channels 30 may enable controlled expansion, while further preventing, choking of the flow C as the cooling fluid absorbs heat from the gas being compressed via the female rotor body portion 22.

The upstream manifold 32 enables fluid communication between the female inlet channel 34 and the cooling channels 30. The upstream manifold 33 may include one or more spokes or spars 35, having a diameter or width, that extend radially from the female inlet channel 34 and connect to the cooling channels 30. Likewise, the downstream manifold 38 enables fluid communication between the cooling channels 30 and the female outlet channel 36. The downstream manifold 38 may include one or more spurs 35, having a diameter or width, that extend radially from the female outlet channel 36 and connect to the cooling channels 30. Consequently, the female inlet channel 34, upstream manifold 32, cooling channels 30, downstream manifold 38, and female outlet channel 36 define the flow path C through the female rotor 20. In at least one embodiment, the diameters of the spars 35 in the downstream manifold 38 may be greater than the corresponding spurs 35 in the upstream manifold 32. Consequently, the volumetric capacity of the flow path through the female rotor 20 generally increases in the direction of flow path C from upstream to downstream, which may enable controlled expansion, while further preventing, choking of the flow C therethrough.

As depicted FIG. 4, the cooling channels 30 may have the same initial diameters at the spur 35 Of the upstream manifold 32 and, similarly, equal ending diameters at the spur 35 of the downstream manifold 38. In at least one embodiment, the initial diameters of the cooling channels 30 may vary radially along the spur 35 of the upstream manifold 32, and the ending diameters of the cooling channels 30 may vary radially along the spur 35 of the downstream manifold 38. For example, the initial diameter of the cooling channel 30 nearest the axis 42 may be larger or smaller than the initial diameter of the cooling channel 30 farthest from the axis 42. Because the flute 28 generally requires more structural strength as the radial distance from the axis 42 increases, the initial diameter of the cooling channel 30 farthest from the axis 42 may be smaller than the cooling channel 30 closest to the axis 42. In at least one alternative embodiment, the female rotor body 22 may include one cooling channel 30 in each flute 28. In such an embodiment, the cross-section of the cooling channels 30 may vary with the radial distance from the axis 42 such that the cooling channels 30 are wider nearest the axis 42 and narrower farthest from the axis 42. The diameter or width, quantity, and distribution of the cooling channels 30 with the female rotor body 22 may be selected depending on the desired flow and heat transfer rates through the female rotor 20 and the structural strength required for the desired flow capacity and outlet pressure of the gas compressor 100, as well as the type of gas to be compressed.

Referring to FIG. 3, in operation, the cooling fluid may be introduced into the female rotor 20 via the female inlet channel 34 in the upstream female shaft portion 24 in the direction of flow path C. The cooling fluid is then pushed through the upstream manifold 32 and into the plurality of cooling channels 30 disposed within the helical flutes 28. As the cooling fluid flows through the cooling channels 30 along the flow path C, heat is transferred from the gas being compressed to the relatively warm flutes 28 to the cooling fluid within the cooling channels 30, which increases the temperature and pressure of the cooling fluid. From the cooling channels 30, the cooling fluid flows through the downstream manifold 38 and out of the female rotor 20 in a heated and at least partially vapor state via the female outlet channel 36 of the downstream female shaft portion 26.

As the temperature of the cooling fluid increases along the flow path C, so may its pressure. However, because the cross-section of the cooling channels 30 increases in the direction of flow path C, each cooling channel 30 enables the cooling fluid to gradually and controllable expand to a prescribed temperature and pressure as further heat is absorbed. In at least one embodiment, the cooling channels 30 may be structured to enable the cooling fluid to change phases from a liquid to a gas through a desired region to further enhance the transfer of heat. For example, heat transferred from the gas being compressed to the cooling fluid may be sufficient to at least partially vaporize the liquid cooling fluid. The change from liquid to gas results in an expansion of the cooling fluid, which may be controlled by the chosen cross-sections of the cooling channels 30, downstream manifold 38, and the female outlet channel 36.

The heat energy required to cause an isothermal change of state from liquid to gas is commonly referred to as the latent heat of vaporization. The latent heat of the cooling fluid represents additional heat energy that may be absorbed from the gas being compressed without further raising the temperature of the cooling fluid. Thus, the latent heat of the cooling fluid provides potential heat transfer capacity to rapidly draw heat from the gas being compressed. Accordingly, the specific dimensions of the female inlet channel 34, the upstream manifold 32 with spurs 35, the cooling channels 30, the downstream manifold 38 with spurs 35, and the female outlet channel 36 may be selected as described herein to at least partially vaporize the cooling fluid at or near the upstream end of rise female rotor 20 adjacent the end of the compression process, where the compressed gas is hottest and where increasing the rate of heat transfer from the compressed gas has the largest positive impact on compressor efficiency. Consequently, the cooling channels 30 may enable sufficient heat transfer from the gas being compressed to reduce the temperature increase associated with the compression process, thereby approaching isothermal compression of the gas and improving the efficiency of the gas compressor 100 relative to conventional gas compressors.

The cooling fluid may be flowed similarly through the male rotor 10. Though the cooling channels 30, and related structures such as the upstream manifold 32, downstream manifold 38 and spurs 35, have been described with respect to the female rotor 20, the male rotor 10 may include these structures as well. In such an embodiment, the male rotor 10 may include the plurality of discrete helical cooling channels 30, as described further herein, formed through the helical lobes 18 along a longitudinal axis 40.

As shown in FIG. 3, the male rotor 10 may include a male body portion 12 disposed between an upstream male shah portion 14 and a downstream male shaft portion its drat are connected at opposite ends to the male body portion 12 along the longitudinal axis 40. The male body portion 12 may include a plurality of helical teeth or lobes 18 formed along the axis 40 and extending from the upstream male shaft portion 14 to the downstream male shaft portion 16. The male body portion 12, the upstream male shaft portion 14, and the downstream male shaft portion 16 may be integrally formed as a single component or may be manufactured as separate components that are attached together to form a rigid body.

The upstream male shaft portion 14 may include a male inlet channel 54 formed along the axis 40 at or near the center of the upstream male shaft portion 14. Likewise, the downstream male shaft portion 16 may include a male outlet channel 56 formed along the axis 40 at or near the center of the downstream male shaft portion 16. In at least one embodiment, a diameter or width of the downstream male shaft portion 16 may be larger than a diameter or width of the upstream male shaft portion 14, which may prevent choking of the flow B as the cooling fluid absorbs heat from the gas being compressed via the male rotor body portion 12, which increases the temperature end pressure of the flow B.

Figure 5:
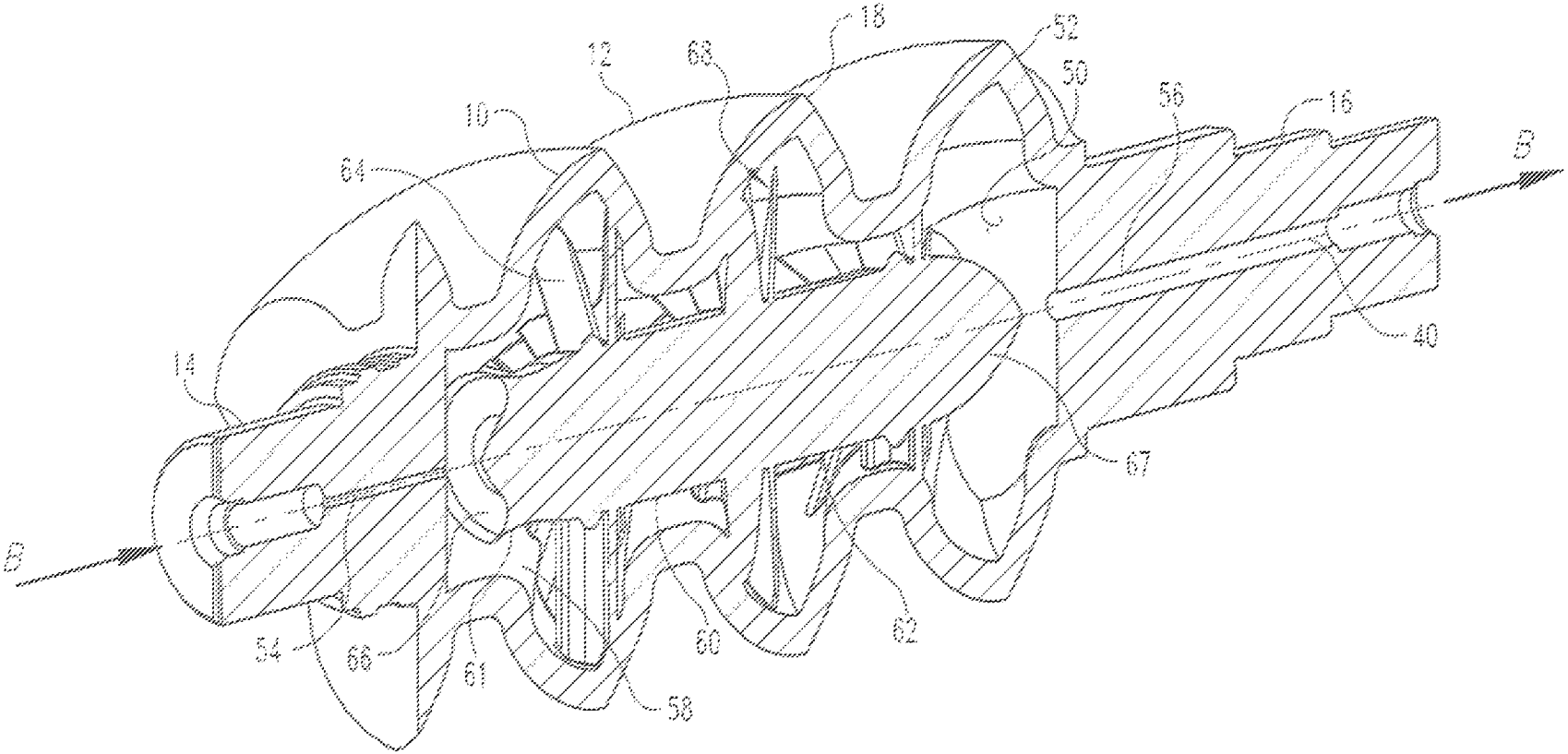
FIG. 5 shows a perspective cross-sectional view of a rotor of a gas compressor according to the present disclosure.

The male body portion 12 may include an internal volume 50 defined by a wall 52 and in fluid communication between the upstream male shaft portion 14 and downstream male shaft portion 16. The wall 52 may further define the lobes 18. Because the wall 52 defines the helical lobes 18, the wall 52 may have a generally multi-lobed helical shape in three dimensions. Further, because the wall 52 at least partially further defines the internal volume 50, the cross-section of the internal volume 50 varies continuously along the axis 40 as shown in FIG. 5. Consequently, the male inlet channel 54, internal volume 50, and male outlet channel 56 define the flow path B through the male rotor 10 having an irregular and varying cross-section.

The male body portion 12 may further include a turbine 60 disposed within the internal volume 50. The turbine 60 may include a turbine body 62 having an upstream end 61 near the upstream male shaft portion 14 and an opposing downstream end 67 near the downstream male shaft portion 16. The turbine 60 enables the male rotor 10 to use the heat energy transferred from the gas being compressed to generate mechanical energy to contribute a torque to assist driving the male rotor 10, thereby increasing the efficiency of the gas compressor 100. To do so, the turbine 60 and the wall 52 of the male body portion 12 may be structured to control the expansion, velocity, and pressure of the cooling fluid as it flows through the male rotor 10. Though the volume 50, turbine 60, and related structures such as the turbine body 62, are described with respect to the male rotor 10, the female rotor 20 may include these structures as well. In such an embodiment, the female rotor 20 may include the volume 50 and turbine 60, as described further herein, formed within the female body portion 22 along the longitudinal axis 42.

Specifically, the upstream end 61 may include an impingement face 66 structured to direct the cooling fluid entering the internal volume 50 via the male inlet channel 54 to disperse throughout the upstream end of the internal volume 50, to prevent stagnation of the flow B. and to create turbulence in the flow B. Dispersal of and turbulence within the flow B increases the rate or heat transfer between the wall 52 and the cooling fluid at the hottest portion of the male rotor 10 adjacent the end of the compression process. Accordingly, the impingement face 66 may have any suitable shape, including but not limited to a generally convex shape, such as conical, parabolic, hyperbolic, complex quadratic, and other developed shapes. The downstream end 67 of the turbine body 62 may include a surface that is generally ogival, conical, bullet-shaped, or otherwise tapered to reduce the turbulence and friction flow losses as the cooling fluid transitions to the male outlet channel 56.

The turbine body 62 may be generally cylindrical with a longitudinal axis substantially parallel to the axis 40 and may have a constant diameter. In at least one embodiment, the diameter or width of the turbine body 62 may decrease in the direction of the flow path B. In such an embodiment, the decreasing diameter or width of the turbine body 62 increases the cross-section of the flow path B enabling further expansion of the cooling fluid as it absorbs heat from gas being compressed via the wall 52. In at least one embodiment, the diameter of the turbine body 62 may fluctuate, decreasing then increasing, to generate a desired flow effect, such as alternating regions of expansion and convergence. The turbine body 62 may be further connected to the wall 52 by blades 64 extending radially from the turbine body 62. In at least one embodiment, the turbine body 62 may be connected to the wall 52 by radial supports (not shown) other than the blades 64. Consequently, the diameter or width of the turbine body 62 and the length and thickness of the blades 64 or supports may be selected to enable adequate structural strength of the male rotor 10 and enable the desired flow characteristics generated by the geometry of the flow path B.

Figure 6:
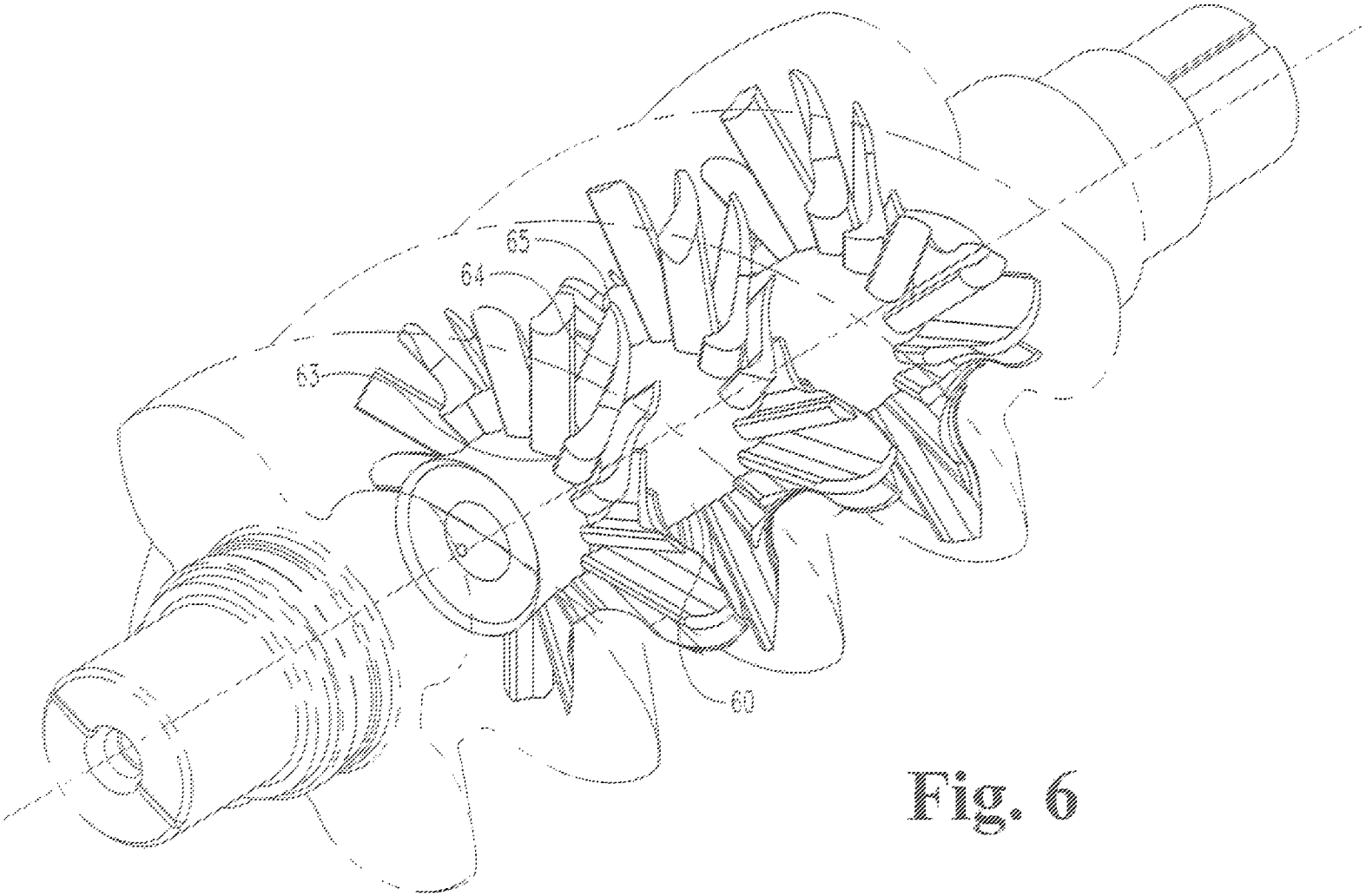
FIG. 6 shows a perspective view of a turbine of a rotor according to the present disclosure.

The blades 64 and/or supports may be arranged in rows or stages 68 along the longitudinal length of the turbine body 62. Though three such stages 68 are depicted in FIG. 5, the turbine 60 may include fewer or more stages 68 depending upon the length of, the required structural strength of, and the desired flow characteristics of the cooling fluid through the male rotor body 12. The stages 68 of blades 64 may be disposed within the internal volume 50 such that expansion chambers 58 are formed upstream of each stage 68, the expansion chambers 58 defined roughly by the wall 52, the turbine body 62, and the blades 64. The varying cross-section of the internal volume 50 results in expansion chambers 58 that may be larger on one side of the turbine body 62 than the other. Further, the varying cross-section of the internal volume 50 yields blades 64 that may be of non-uniform length because Use distance from the turbine body 62 to the wall 52 varies with the helical shape of the male rotor body 12 as shown in FIG. 6. In certain embodiments, the blades 64 may be structured in a staggered arrangement along and around the longitudinal length of the turbine body 62 such that the blades 64 do not comprise defined stages 68 and further do not have uniform lengths.

Figure 7:
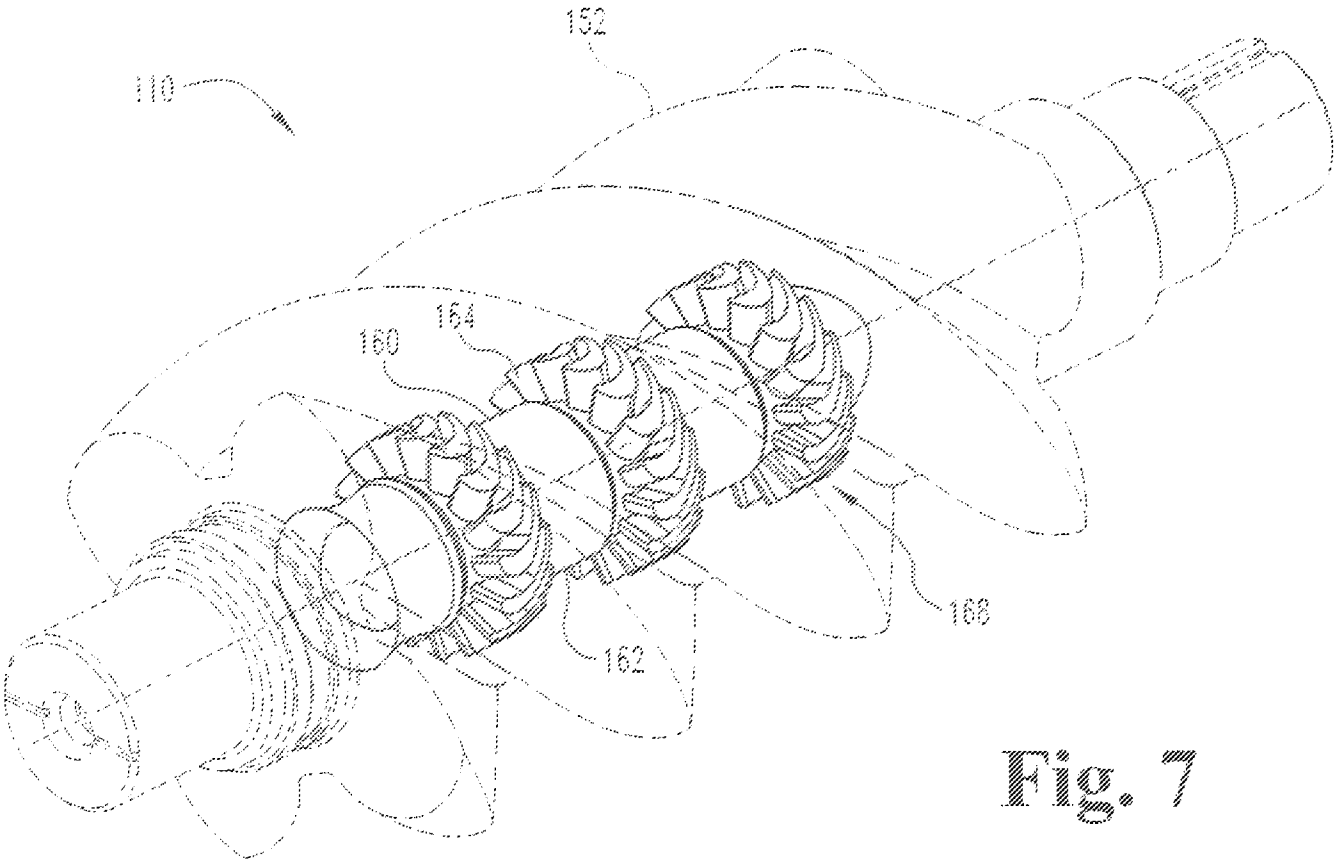
FIG. 7 shows a perspective view of an alternative turbine of a rotor according to the present disclosure.

In at least one embodiment, the blades of the internal turbine may have uniform length. As shown in FIG. 7, a male rotor 110 may include a turbine 160 having a plurality of blades 164 of uniform length. Such an embodiment may include aerodynamic, structural, or manufacturing benefits relative to the blades 164 of non-uniform length. In such an embodiment, the blades 164 may extend radially from a turbine body 162 a common uniform distance. Further, a wall 152 of the male rotor 110 may include a rib (not shown) extending radially toward the turbine body 162 such that the rib connects to the blades 164. To maintain a desired cross-sectional flow area through a given stage 168, the diameter of the turbine body 162 may be reduced opposite the rib. The rib may extend from the wall 152 around the entire circumference of the turbine body 162. Alternatively, the rib may include a plurality of rib sections connected to one or more blades 164 as described herein. In a further alternative embodiment, the blades 164 may connect with the wall 152 by other means. The male rotor 110 with blades 164 of uniform length may otherwise have the same properties, characteristics, and function as the male rotor 10 having blades 64.

Figure 8:
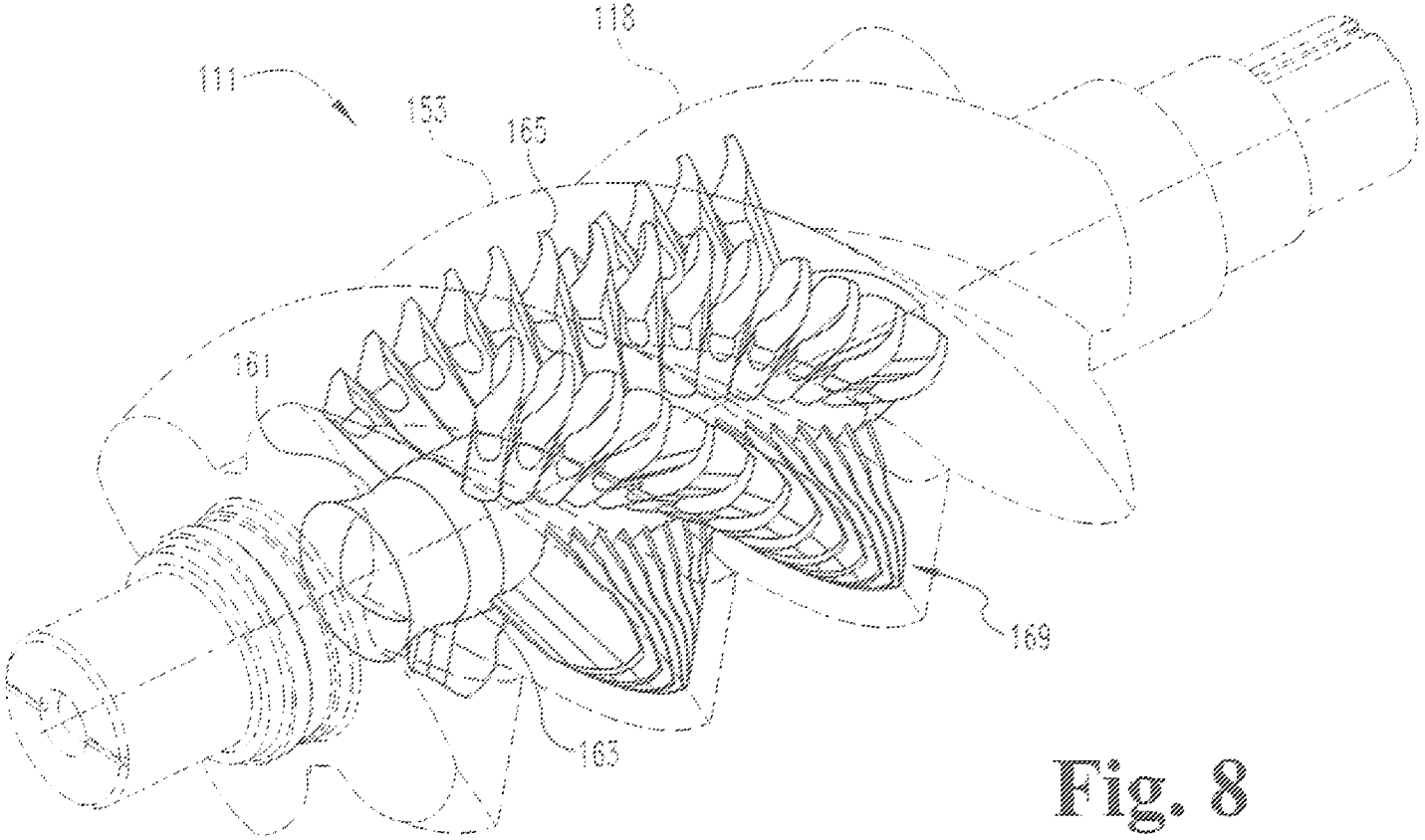
FIG. 8 shows a perspective view of an alternative turbine of a rotor according to the present disclosure.

In at least one embodiment according to the present disclosure, a male rotor 111 may include a turbine 161 having a plurality of blades 165 may be structured in a helix along and around the longitudinal length of a turbine body 163 as shown in FIG. 8. In such an embodiment, the blades 165 may be arranged in stages 169 structured in a helix along and around the longitudinal length of a turbine body 163. Further, the helical stages 169 may be structured to follow helical lobes 118 of the male rotor 111 such that the blades 165 of a given stage 169 have a common uniform length, the distance from the turbine body 163 to a wall 153 of the male rotor 111 being the same along a helix following the helical lobes 118. Moreover, expansion chambers, similar to the expansion chambers 58, may be structured in a generally helical shape upstream of the helical stages 169. The male rotor 111 with helically arranged blades 165 may otherwise have the same properties, characteristics, and function as the male rotor 10 having blades 64.

Referring to FIG. 6, the blades 64 of the turbine 60 may have a shape similar in cross-section to an airfoil, where each blade 64 has a substantially rounded upstream leading edge 63 and a tapered trailing edge 65 with an asymmetric chamber in between. In such an embodiment, each blade 64 may be structured to generate an aerodynamic force when placed in a fluid flow, thereby extracting energy from the cooling fluid flow B and generating torque in the male rotor 10. In a conventional reaction turbine, the turbine rotates relative to a flow channel and to stationary nozzles or vanes that accelerate and direct a flow over turbine blades. Unlike a conventional turbine, the turbine 60 is stationary relative to the wall 52 of the male rotor body 12. Referring to FIG. 3, the acceleration of the cooling fluid through the blades 64 is generated by the expansion chambers 58, where heat transferred from the gas being compressed via the wall 52 heats and expands the cooling fluid in the fixed volumes of the expansion chambers 58. The heated and expanded cooling fluid flows over and past each blade 64 in each stage 68, which changes both the relative velocity and pressure of the flow B and imparts a torque on the blades 64, thereby contributing to the rotation of the male rotor 10. Consequently, heat transferred from the gas being compressed is converted into the aerodynamic force generated by the blades 64, which is further converted into torque that contributes to driving the male rotor 10. Thus, the load on the motor, spindle or other suitable torque source driving the male rotor 10 is reduced, which reduces the work energy input into the compression process, thereby improving the efficiency of the gas compressor 100.

The specific dimensions of the male inlet channel 54, the internal volume 50, the impingement face 66, the expansion chambers 58, the blades 64, and the male outlet channel 56 may be selected to at least partially vaporize the cooling fluid at or near the upstream end of the male rotor 10 adjacent the end of the compression process, where the compressed gas is hottest and where increasing the rate of heat transfer from the compressed gas has the largest positive impact on compressor efficiency. Concurrently, the male inlet channel 54, the internal volume 50, the wall 52, the impingement face 66, the expansion chambers 58, the blades 64, and the male outlet channel 50 are sized to ensure the male rotor 10 has sufficient structural strength to withstand the operating conditions of the gas compressor 100. In at least one embodiment the expansion chambers 58, particularly the most upstream expansion chamber 58, may be structured to enable sufficient heat transfer from the gas being compressed to the cooling fluid to at least partially vaporize the liquid cooling fluid and to accelerate the cooling fluid through the blades 64, thereby facilitating evaporative cooling of the male rotor body 12 as the cooling fluid at least partially changes phase from liquid to gas.

Referring to FIG. 5, in operation, the cooling fluid may be introduced into the male rotor 10 via the male inlet channel 24 in the upstream male shaft portion 24 in the direction of flow path B. The cooling fluid is then pushed into the internal volume 50, where it may fall incident upon the impingement face 66 of the turbine 60 and be directed to disperse throughout the upstream end of the internal volume 50, thereby preventing stagnation of the flow B, creating turbulence in the flow B. and improving the cooling fluid distribution. Because the upstream end of the male rotor 10 is the hottest, dispersion of the cooling fluid facilitates at least partial vaporization of the cooling fluid and, thus, evaporative cooling of the mate rotor body 12. The expanding cooling fluid flows downstream into the expansion chamber 58, where the cooling fluid continues to absorb heat transferred from the male rotor body 12 and further accelerates over the blades 64 of a stage 68. The cooling fluid changes velocity and pressure as it flows over the blades 64 and imparts an aerodynamic force on the blades 64, which generates torque in the rotating male rotor 10. In certain embodiments, the cooling fluid may then flow into another expansion chamber 58, where the cooling fluid continues to absorb heat transferred from the male rotor body 12 and further accelerates over the blades 64 of a subsequent stage 68, thereby generating further torque. After passing through the last stage 68, the cooling fluid flows downstream and into the male outlet channel 26 and out of the male rotor 10 in a heated and at least partially vapor state.

Figure 9:
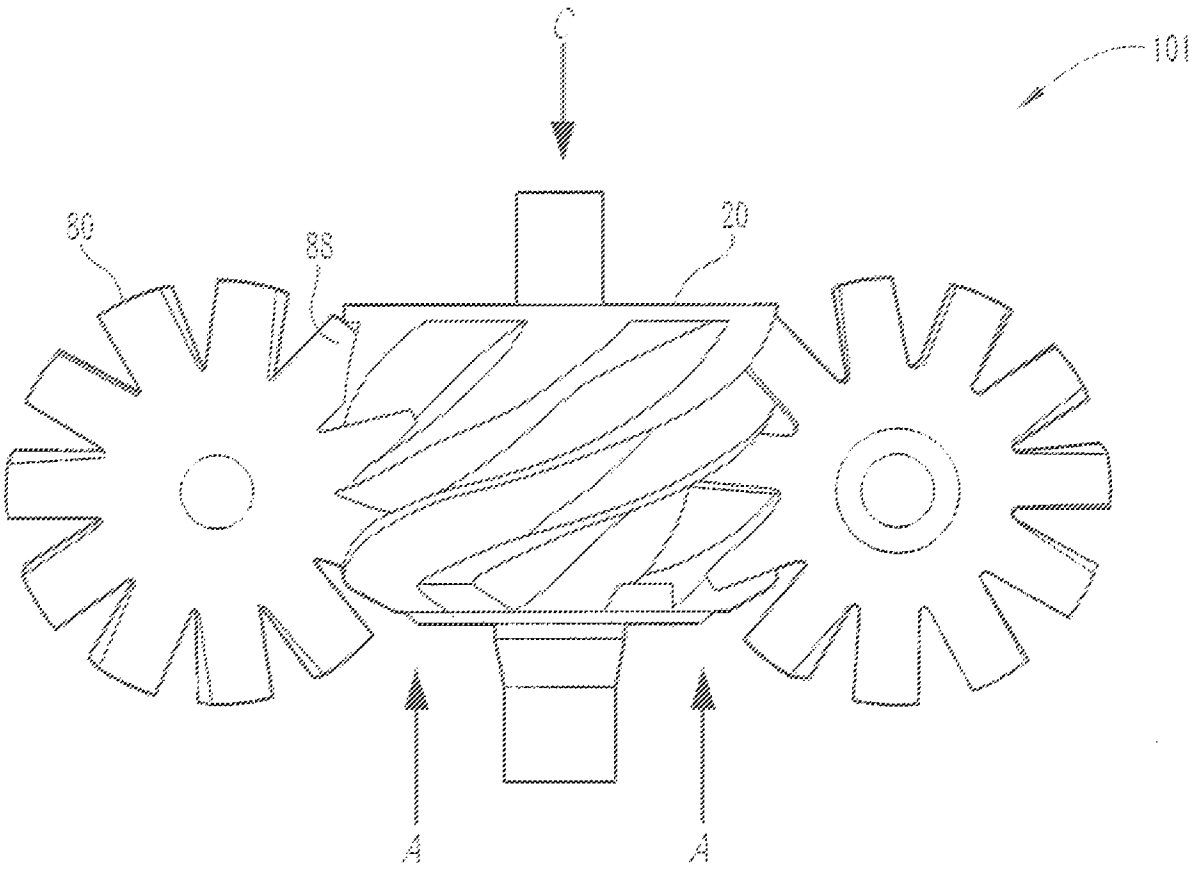
FIG. 9 shows a plan view of an embodiment of a gas compressor according to the present disclosure.

In at least one embodiment according to the present disclosure, a gas compressor 101 may include a housing (not shown) having an inlet and an outlet the female rotor 20, and a gate rotor 80 as shown in FIG. 9. The gate rotor 80 may include a plurality of gate teeth 88 structured to intermesh with the flutes 28 of the female rotor 20 to compress a gas. The gate rotor 80 may rotate about an axis that is perpendicular to the axis 42. In at least one embodiment, the gas compressor 101 may include two gate rotors 80, each structured to intermesh with the flutes 28 of the female rotor 20 to compress a gas as the gate rotors 80 and female rotor 20 are rotated about their respective axes. Accordingly, the gas compressor 101 may operate similar to the gas compressor 100, continuously creating compression ceils between the teeth 88 of the gate rotors 80, the flutes 28 of the female rotor 20, and the housing of the compressor 101. The gas to be compressed may be introduced via the inlet along a compressor flow path A. Rotation of the rotors 80, 20 draws the gas to be compressed between the rotors 80, 20 in the direction of flow path A, as shown in FIG. 9, and into the compression cells formed therebetween. As the rotors 80, 20 rotate, each compression cell is closed and then reduced in volume to compress the gas.

As in the gas compressor 100, the gas compressor 101 may include the flow path C through the female rotor 20 running counter to the flow path A. In such an embodiment, relatively cold cooling thud in its coldest state is introduced into the female rotor 20 adjacent the end of the compression process near the gas outlet, adjacent the hottest compressed gas temperatures and the greatest heating of the female rotor 20. Thus, the counter-flow of the compressor flow A to the cooling fluid flow C increases the rate of heat transfer between the relatively hot compressed gas and the relatively cold cooling fluid at a location where cooling of the compressed gas offers the greatest contribution to compressor efficiency.

In at least one embodiment, the gas compressor 100 is a dry compressor, and all the cooling capacity of the gas compressor 100 is enabled by flowing the cooling fluid through the male rotor 10 and female rotor 20. In an alternative embodiment, the gas compressor 100 may be further cooled by other conventional means in addition to flowing the cooling fluid through the male rotor 10 and female rotor 20. For example, the gas compressor 100 may be contact cooled by former introducing a coolant into the flow A at or near the inlet of the compressor housing. Commonly, water or oils may be used as the coolant. In at least one embodiment, the coolant and the cooling fluid may be two different materials. Alternatively, the coolant and the cooling fluid may be the same material but maintained in separate flow circuits such that the cooling fluid does not enter the flow path A.

The gas compressor 100 may be used in any suitable application. The gas compressor 100 may be particularly suited for mobile applications because the material absent from the male rotor 10 to define the flow path B, and the material absent from the female rotor 20 to define the flow path C, reduce the total mass of the gas compressor 100 compared to conventional compressor rotors, making the gas compressor 100 more easily transported. Further, the reduced mass of material in the gas compressor 100 may lower the cost of the gas compressor 100 relative to conventional compressor rotors. In at least one embodiment, the gas compressor 100 may generate compressed gas at a pressure between zero pounds per square inch gauge (psig) and about 200 psig at a temperature ranging from about 160.degree. F. to about 550.degree. F.

The cooling fluid may be any suitable liquid having a boiling point within the operating temperature range of the gas compressor 100 to enable latent heat transfer to the cooling fluid and evaporative cooling of the male rotor 10 and female rotor 20 as described herein. Examples may include, but not be limited to, water, oils, and refrigerants. As will be understood by one skilled in the art having the benefit of the present disclosure, in operation the cooling fluid may include a mixture of liquid and gas states. For example, cooling fluid entering the rotors 10, 20 may be primarily liquid but may include some gaseous cooling fluid. Further, in certain embodiments under certain operating conditions, the cooling fluid exiting the rotors 10, 20 may be primarily gaseous but may include some liquid cooling fluid. Moreover, in at least one embodiment the cooling fluid may be a liquid having a boiling point outside the operating temperature range of the gas compressor 100 such that the cooling fluid remains substantially liquid under all operation conditions. Alternatively, the flow path B of the male rotor 10 and the flow path C of the female rotor 20 may be structured that, regardless of its boiling point, the selected cooling fluid remains substantially liquid under all operation conditions.

The gas compressor 100 may be manufactured by any suitable process. However, given the intricate features of the male rotor 10 and the female rotor 20, it may not be possible to manufacture the gas compressor 100 using conventional molding, casting, or machining methods. In at least one embodiment according to the present disclosure, the male rotor 10 and female rotor 20 may be manufactured using an additive manufacturing process. Additive manufacturing is the process of forming an article by the selective fusion, sintering, or polymerization of a material stock. Additive manufacturing includes the use of a discretized computer-aided design ("CAD") data model of a desired part to define layers that may be processed successively in sequence to form the final integrated part. Additive manufacturing includes powder bed fusion ("PBF") and powder spray fusion ("PSF") manufacturing processes, including selective laser melting (A "SLM") direct metal laser sintering ("DMLS"), selective laser sintering ("SLS"), and electron beam melting ("EBM"). PBF and PSF processes share a basic set of process steps, including one or more thermal sources to induce melting and fusing between powder particles of a material stock, a means for controlling fusion of the powder particles within prescribed regions of each layer of the discretized CAD model, and a means of depositing the powder particles on the previously fused layers forming the part-in-process. The prescribed regions of each layer are defined by the cross-section of the part CAD model in a given layer. Because the powder particles are melted and fused to the previous layer, the resultant part may be solid, substantially fully dense, substantially void-free, and has substantially equivalent or superior thermal and mechanically properties of a part manufactured by conventional molding, casting, or machining methods. Alternatively, the resultant past may include a desired degree of porosity by appropriate control of the manufacturing process.

Figure 10:
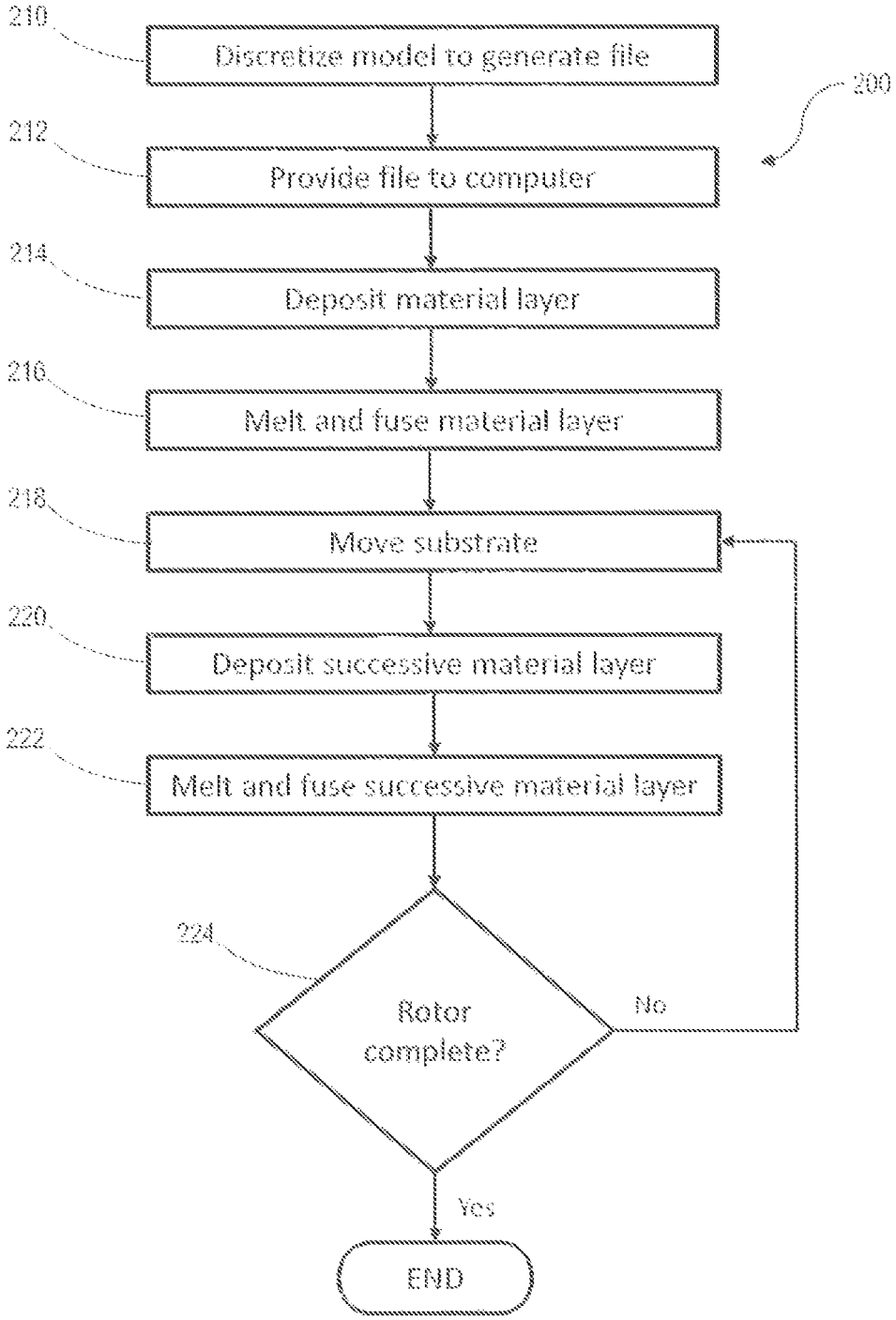
FIG. 10 illustrates a method of fabricating a rotor according to the present disclosure.

A rotor, such as the male rotor 10 and female rotor 20 of the gas compressor 100, may be formed using an additive manufacturing method 200. As shown in FIG. 10, the method 200 may include an operation 210 of discretizing CAD models of the rotors 10, 20 into rotor layers to generate a file, such that each rotor layer defines a particular cross-section of the rotor. By way of non-limiting example, the file may be a standard tessellation language, commonly referred to as a "STL file", or other suitable file format. The method 200 may include an operation 212 of providing the file to a computer programmed to control a thermal source. The method 200 may further include an operation 214 of depositing a material layer of material stock (e.g., powder particles) on a substrate and an operation 216 of melting and fusing the material layer within a region defining a first rotor layer of the rotors 10, 20 using the thermal source. The method 200 may include an operation 218 of moving the substrate an incremental distance to create space for a successive rotor layer. The method 200 may include an operation 220 of depositing a successive material layer of powder particles on the first rotor layer. Use method 200 may further include an operation 222 of melting and fusing the successive material layer within a region defining a successive color layer of the rotors 10, 20 using the thermal source. The method 200 may include an operation 224 of repeatedly depositing and melting successive material layers defining the successive rotor layers of the rotors 10, 20 in sequence until all discretized rotor layers have been melted and fused to form the part in whole.

The thermal sources for inducing melt and fusion of the powder particles may include without limitation a high-powered laser (e.g., a 200 watt Yb-fiber optic laser or a carbon dioxide laser) or an electron beam. A computer may be used to control the location of melting and fusing within the regions of each layer defining the cross-section of the rotors 10, 20. Movement of the substrate may be enabled by a translation table structured to position the part-in-process such that successive layers of powder particles may be deposited and fused to form each successive layer of the part. In at least one embodiment, the translation table may be a vertically translating platform that is incrementally lowered from an initial starting position to create space for each successive layer of material stock to be deposited and fused. In such an embodiment, the unmelted and unfused material from prior successive layers may accumulate in and around the part-in-process, thereby surrounding and supporting the part-in-process during manufacturing.

The means of deposition the powder particles may include, for example in the PBF process, a wiper arm or roller that deposits a uniform layer of material stock on a substrate, as the process is initiated, or on the previously deposited and fused layer, as successive layers are added. In at least one embodiment, for instance one using the PSF process, the means of deposition the powder particles may include a spray of powder particles from a nozzle. Each layer may be between about 10 micrometers (.mu.m) and about 100.mu.m thick. In some embodiments, each layer may be between about 20.mu.m and about 50.mu.m. Further, the method 200 may operate at an elevated temperature, typically between 700 and 1.000.degree. C., which may generate parts with low residual stress, thereby eliminating the need for heat treatment after the build to strengthen and stabilize the part. Moreover, the method 200 may operate in a vacuum, a controlled environment of inert gas (e.g., argon or nitrogen at oxygen levels below 500 parts per million), or in standard atmospheric conditions. The powder particles may include more than one kind of material stock. In such an embodiment, the method 200 may be used to make a part composed of an alloyed material of the different material stocks.

Alternatively, the male rotor 10 and female rotor 20 may be manufactured using a fused deposition modeling ("FDM") process. Though similar to PDF processes in many respects, in FDM, instead of using powder particles, the material stock may be a coil of wire fed into a nozzle which melts and deposits the molten material in regions defining a given layer of the part-in-process. Nonetheless, the FDM process includes of deposition of material stock in discretized layers and fusing each successive layer to the previous layer.

The male rotor 10 and the female rotor 20 may be made of any suitable material, including but not limited to, steel, stainless steel, maraging steel, carbon steel, cobalt chromium, inconel, titanium, and titanium aluminide. In at least one embodiment, the male rotor 10 and the female rotor 20 may be made of any material that is compatible with the additive manufacturing method 200, including but not limited to, steel, stainless steel, maraging steel, carbon steel, cobalt chromium, inconel, titanium, and titanium aluminide.

One aspect of the present disclosure provides a screw compressor rotor having an exterior compression surface defined by a helical shape, the helical shape axially extending from a first end to a second end and having a helical grooved valley situated between opposing helical valley walls, the screw compressor rotor having a cooling fluid inlet disposed in the first end to receive a cooling fluid and a plurality of separate cooling passages disposed internal to the screw compressor rotor, the plurality of separate cooling passages in fluid communication with the cooling fluid inlet such that the cooling fluid inlet feeds cooling fluid to the plurality of separate cooling passages, the plurality of cooling passages having cross sectional areas that increase along a direction from an upstream end to a downstream end of the plurality of cooling passages.

In one feature of the present disclosure, the cooling fluid inlet is located on a centerline of the screw compressor rotor, and the plurality of separate cooling passages follow the helical shape. In another embodiment, the plurality of separate cooling passages include a plurality of spokes radiating out from a passage extending from the cooling fluid inlet and connected to the plurality of separate cooling passages. Yet another embodiment further includes a cooling fluid outlet disposed in the second end of the screw compressor rotor and located on the centerline. In one feature of the present application, the plurality of separate cooling passages include a plurality of spokes radiating between the cooling fluid outlet and each of the plurality of separate cooling passages, in a further feature, the cooling fluid inlet is disposed on a downstream compression side of the screw compressor rotor such that the cooling fluid is in a counter flow relationship with a working fluid compressed by action of the exterior compression surface. In another feature, the cooking fluid is a refrigerant fluid, and the increase in cross sectional area of the plurality of passages accommodates a phase transition of the refrigerant such that a vapor form of the refrigerant remains unchoked as it traverses the plurality of passages.

One aspect of the present disclosure provides a compressor rotor having an external helical compression surface structured for engagement with a complementary shaped compressor rotor to form a rotary screw compressor, the external helical compression surface including a helical valley formed between adjacent helical walls, the compressor rotor having an inlet aperture into which passes a cooling fluid tor passage to an interior of the compressor rotor, an outlet aperture from which passes the cooling fluid, and an open interior volume located between the inlet aperture and outlet aperture and into which is disposed a plurality of turbine blades having an airfoil shape oriented to extract work from the cooling fluid traversing through the open interior volume.

One feature of the present disclosure further includes a central body disposed interior to the open interior volume and axially separated from an upstream entrance to the open interior volume and a downstream exit from the open interior volume such that a spatial offset is provided. In one feature of the present disclosure, the plurality of turbine blades are integral with the helical walls and central body. Another feature further includes an impingement face disposed in an upstream portion of the open interior volume to increase turbulence of the cooling fluid end thereby increase heat transfer from the helical compression surface to the cooling fluid. In yet another feature, the plurality of turbine blades are arranged in one of: (1) staged rows; and (2) a helical pattern between an upstream end of the compressor rotor and a downstream end of the compressor rotor. In a further feature, the turbine is one of an impulse turbine and a reactive turbine. In at least one embodiment the compressor rotor is a male rotor having lobes. One feature includes a cross sectional area of the open interior that increases in a direction of flow of the fluid when it traversed through the open interior.

One aspect of the present disclosure provides a screw compressor including a first compressor rotor structured to rotate about a first axis and having a first compression surface, a second compressor rotor structured to rotate about a second axis and having a second compression surface, the first and second compressor rotors configured for complementary engagement via first and second compression surfaces and operable to produce a pressure rise in a compressible gas when the first compressor rotor and second compressor rotor are rotated about the first axis and second axis, respectively, the first compressor rotor having an internal cooling circuit structured to flow a first compressor rotor cooling fluid and thereby absorb heat generated during compression of the compressible gas, the second compressor rotor including a turbine disposed radially inward of the second compression surface and structured to extract work from a second compressor rotor cooling fluid passing internal to the second compressor rotor.

One feature of the present disclosure further includes a cyclic refrigerant cooling system including a compressor for compression of a refrigerant, the first compressor rotor and/or the second compresses rotor acting as the evaporator of the cyclic refrigerant cooling system. Another feature further includes a passage in the cyclic refrigerant cooling system leading to a branch that feeds a first rotor cooling fluid passage and a second rotor cooling fluid passage, the first rotor cooling fluid passage having a first valve structured to control an amount of cooling fluid passing therethrough, and the second rotor cooling fluid passage having a second valve structured to control an amount of cooling fluid passing therethrough. Yet another feature further includes a refrigerant cooling system, and wherein the internal cooling circuit of the first compressor rotor includes a plurality of passages originating from a central feed passage, radiating to a radial outer portion or the first compressor rotor, and returning to a central return passage. In one feature, the turbine includes plurality of turbine blades and an internal turbulator upstream of the plurality of turbine blades structured to promote turbulence in the second compressor rotor cooling fluid passing internal to the second compressor rotor.

While various embodiments of a rotor for a gas compressor and methods for constructing and using the same have been illustrated and described in detail in the drawings and foregoing description, the same is to be considered as illustrative and not restrictive in character, it being understood that only the preferred embodiments have been shown and described and that all changes and modifications that come within the spirit of the inventions are desired to be protected. It should be understood that while the use of words such as preferable, preferably, preferred or more preferred utilized in the description above indicate that the feature so described may be more desirable, it nonetheless may not be necessary and embodiments lacking the same may be contemplated as within the scope of the invention, the scope being defined by the claims that follow. In reading the claims, it is intended that when words such as "a," "an," "at least one," or "at least one portion" are used there is no intention to limit the claim to only one item unless specifically stated to the contrary in the claim. When the language "at least a portion" and/or "a portion" is used the item can include a portion and/or the entire item unless specifically stated to the contrary.

Further, in describing representative embodiments, the disclosure may have presented a method and/or process as a particular sequence of steps. However, to the extent that the method or process does not rely on the particular order of steps set forth herein, the method or process should not be limited to the particular sequence of steps described. Other sequences of steps may be possible and are therefore contemplated by the inventor. Therefore, the particular order of the steps disclosed herein should not be construed as limitations of the present disclosure. Such sequences may be varied and still remain within the scope of the present disclosure.

The invention claimed is:

1. An apparatus comprising:

a screw compressor rotor formed by a solid helical screw having an exterior compression surface, the solid helical screw axially extending from a first end to a second end and having a helical grooved valley situated between opposing helical valley walls, the screw compressor rotor having a cooling fluid inlet channel disposed on a centerline of the first end to receive a cooling fluid and an upstream manifold forming a plurality of spokes radially extending from the cooling fluid inlet channel;

wherein the plurality of spokes is configured to direct the cooling fluid to a plurality of separate cooling passages formed within the solid helical screw of the screw compressor rotor, the plurality of separate cooling passages in fluid communication with the cooling fluid inlet channel such that the cooling fluid inlet channel feeds cooling fluid to the plurality of separate cooling passages, the plurality of separate cooling passages having cross sectional areas that increase along a direction from an upstream end to a downstream end of the plurality of separate cooling passages; and wherein the diameter of the plurality of cooling passages vary radially along a length of each one of the plurality of spokes.

2. The apparatus of claim 1, wherein the plurality of separate cooling passages follow a helical shape of the solid helical screw.

3. The apparatus of claim 1, which further includes a cooling fluid outlet channel disposed in the second end of the screw compressor rotor and located on the centerline.

4. The apparatus of claim 3, wherein the plurality of separate cooling passages includes a downstream manifold forming a plurality of spokes radiating from the cooling fluid outlet channel to each of the plurality of separate cooling passages.

5. The apparatus of claim 4, wherein the cooling fluid inlet channel is disposed on a downstream compression side of the screw compressor rotor such that the cooling fluid is in a counter flow relationship with a working fluid compressed by action of the exterior compression surface.

6. The apparatus of claim 4, wherein the cooling fluid is a refrigerant fluid, and wherein the increase in cross sectional area of the plurality of passages accommodates a phase transition of the refrigerant such that a vapor form of the refrigerant remains unchoked as it traverses the plurality of passages.

7. A rotary screw compressor configured to compress a working fluid, the rotary screw compressor comprising:

a screw compressor rotor formed by a solid helical screw having an exterior compression surface, the solid helical screw axially extending from a first end to a second end and having a helical grooved valley situated between opposing helical valley walls, the screw compressor rotor having a cooling fluid inlet channel disposed on a centerline of the first end to receive a cooling fluid and an upstream manifold forming a plurality of spokes radially extending from the cooling fluid inlet channel, the upstream manifold having a smaller cross sectional area than a downstream manifold;

wherein the plurality of spokes is configured to direct the cooling fluid to a plurality of separate cooling passages formed within the solid helical screw of the screw compressor rotor, the plurality of separate cooling passages in fluid communication with the cooling fluid inlet channel such that the cooling fluid inlet channel feeds cooling fluid to the plurality of separate cooling passages, the plurality of separate cooling passages having cross sectional areas that increase along a direction from an upstream end to a downstream end of the plurality of separate cooling passages; and wherein the diameter of the plurality of cooling passages vary radially along a length of each one of the plurality of spokes.

8. The rotary screw compressor of claim 7, wherein the plurality of separate cooling passages follow a helical shape of the solid helical screw.

9. The rotary screw compressor of claim 7, which further includes a cooling fluid outlet channel disposed in the second end of the screw compressor rotor and located on the centerline.

10. The rotary screw compressor of claim 9, wherein the plurality of separate cooling passages includes the downstream manifold forming a plurality of spokes radiating from the cooling fluid outlet channel to each of the plurality of separate cooling passages.

11. The rotary screw compressor of claim 10, wherein the cooling fluid inlet channel is disposed on a downstream compression side of the screw compressor rotor such that the cooling fluid is in a counter flow relationship with a working fluid compressed by action of the exterior compression surface.

12. The rotary screw compressor of claim 10, wherein the cooling fluid is a refrigerant fluid, and wherein the increase in cross sectional area of the plurality of passages accommodates a phase transition of the refrigerant such that a vapor form of the refrigerant remains unchoked as it traverses the plurality of passages.

13. An apparatus comprising:

a screw compressor rotor formed by a solid helical screw having an exterior compression surface, the solid helical screw axially extending from a first end to a second end and having a helical grooved valley situated between opposing helical valley walls, the screw compressor rotor having a cooling fluid inlet channel disposed on a centerline of the first end to receive a cooling fluid and an upstream manifold forming a plurality of spokes radially extending from the cooling fluid inlet channel, the upstream manifold having a smaller cross sectional area than a downstream manifold;

wherein the plurality of spokes is configured to direct the cooling fluid to a plurality of separate cooling passages formed within the solid helical screw of the screw compressor rotor, the plurality of separate cooling passages in fluid communication with the cooling fluid inlet channel such that the cooling fluid inlet channel feeds cooling fluid to the plurality of separate cooling passages; and wherein the diameter of the plurality of cooling passages vary radially along a length of each one of the plurality of spokes.

14. The apparatus of claim 13, wherein the plurality of cooling passages have cross sectional areas that increase along a direction from an upstream end to a downstream end of the plurality of cooling passages.

15. The apparatus of claim 13, further including a cooling fluid outlet channel disposed in the second end of the screw compressor, the cooling fluid outlet channel located on a centerline of the screw compressor rotor, wherein the plurality of separate cooling passages follow a helical shape of the solid helical screw.

16. The apparatus of claim 15, wherein the plurality of separate cooling passages includes the downstream manifold forming a plurality of spokes radiating from the cooling fluid outlet channel to each of the plurality of separate cooling passages.

17. The apparatus of claim 16, wherein the cooling fluid inlet channel is disposed on a downstream compression side of the screw compressor rotor such that the cooling fluid is in a counter flow relationship with a working fluid compressed by action of the exterior compression surface.

18. The apparatus of claim 16, wherein the cooling fluid is a refrigerant fluid, and wherein an increase in cross sectional area of the plurality of passages accommodates a phase transition of the refrigerant such that a vapor form of the refrigerant remains unchoked as it traverses the plurality of passages.

* * * * *